US005081752A

United States Patent [19]

Reinhard et al.

[11] Patent Number: 5,081,752

[45] Date of Patent: Jan. 21, 1992

[54] INSTALLATION FOR PRODUCING FLAT TEXTILE BODIES

[75] Inventors: Ruedi Reinhard, Weggis; Michael Dorn, Frick, both of Switzerland

[73] Assignee: Texilma AG, Hergiswil, Switzerland

[21] Appl. No.: 499,371

[22] PCT Filed: Sep. 28, 1989

[86] PCT No.: PCT/CH89/00175

§ 371 Date: Jul. 19, 1990

§ 102(e) Date: Jul. 19, 1990

[87] PCT Pub. No.: WO90/04062

PCT Pub. Date: Apr. 19, 1990

[30] Foreign Application Priority Data

Oct. 4, 1988 [CH] Switzerland ..... 370/88-5

[51] Int. Cl.[5] ..... D04H 11/00

[52] U.S. Cl. ..... 28/140

[58] Field of Search ..... 38/102.91; 28/140

[56] References Cited

U.S. PATENT DOCUMENTS

| | | | |
|---|---|---|---|
| 1,392,123 | 9/1921 | Danisi | 38/102.91 |
| 1,403,505 | 1/1922 | Landis | 38/102.91 |
| 1,411,908 | 4/1922 | Cacici | 38/102.91 |
| 2,080,886 | 5/1937 | Fowler | 28/140 X |
| 2,443,358 | 6/1948 | Michaelis | 2/278 |

FOREIGN PATENT DOCUMENTS

| | | |
|---|---|---|
| 579482 | 4/1929 | Fed. Rep. of Germany . |
| 830042 | 1/1952 | Fed. Rep. of Germany . |
| 2044778 | 5/1970 | France . |
| 472707 | 9/1937 | United Kingdom . |

OTHER PUBLICATIONS

Verband Der Deutschen, Heimtextilien-Industrie EV pp. A6-A9.

Abe dahr-Dorel, Von der Faser Zum Stoff pp. 102-103.

Alfons Hoffer, Stoffe 2 pp. 62-69.

*Primary Examiner*—Werner H. Schroeder

*Assistant Examiner*—John J. Calvert

[57] ABSTRACT

An installation comprised of a weaving or knitting machine and a packeting apparatus forms a flat textile body that can be cut along its central plane into two symmetrical pile carpets. In the installation the body is formed by severing a woven or knitted band of material having at least one edge section and floating web threads. A severing mechanism cuts the band into segments which are then transferred and stacked adjacent to one another in a magazine while a tensioning device maintains a nearly uniform tension on the band between the weaving or knitting machine and the magazine. Several additional mechanisms are provided to adhesively or thermally join the band segments together along the edge sections.

15 Claims, 4 Drawing Sheets

INSTALLATION FOR PRODUCING FLAT TEXTILE BODIES

Figure 1:
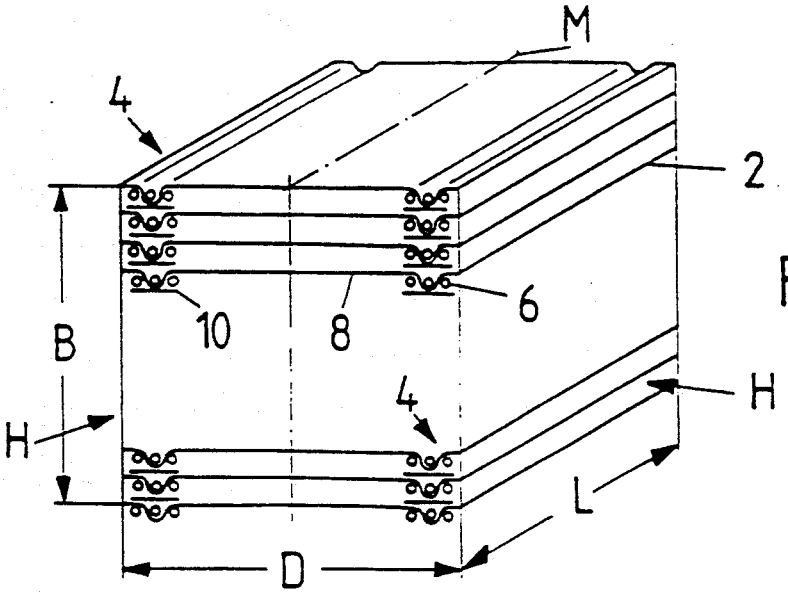

The invention concerns an installation for producing flat textile bodies.

Such flat bodies can be used in many different ways, for example as heat insulating panels, sound insulating panels, reinforcement of plastics, filter panels and especially for the manufacture of pile carpet panels.

In past decades many efforts have been undertaken to improve productivity in the manufacture of pile carpet panels and to simultaneously enhance design possibilities.

In DE-PS 579,482 and GB-PS 472,707 pile carpets are made by gluing individual threads (yarn sheets) on intermediate layers, which carpets however exhibit only low strength as the pile threads are only glued together over a small area without being mechanically connected. In DE-PS 1,071,040 a block is formed by embedding layers of individual threads in a hardening agent, which block is cut into panels. Here as well the strength of the resulting product is too low because of the lack of mechanical bonding.

GB-PS 589,908 describes the manufacture of a pile carpet through the use of strips consisting of cut woven webs. In the middle of the strips are warp threads applied by glue or sewing to a lower stratum. The free floating, cut weft threads to the left and right of the warp threads are bent upwardly as the pile threads and form the visible portion of the carpet whose thickness is determined by the spacing of the strips. Because of the troublesome application of the strips to the lower stratum, this process has not yet been put into practice.

A process is described in DE-PS 830,042 in which unwoven materials, such as yarns, are pressed into bales, cut into slices and then coated or bonded on one of the free surfaces.

In FR-OS 2,044,778 pile carpets are described whose pile consists of the weft yarn of folded woven webs. The woven webs are folded in zigzag fashion to form a block. From this coated layers are successively cut off so that the formerly floating weft threads are bonded with one end by the coating substrate and with their other ends form the surface of the pile carpets. Again, the poor mechanical anchoring of the pile threads leads to a low wear resistance of the carpet.

The problem of anchoring the pile threads is the subject of CH-PS 401,892. Therein the individual pile rows are bonded on both sides to band shaped intermediate layers and are thereby joined pile row by pile row to one another. The result is a very stable assembly and a high quality pile carpet.

The method described in CH-PS 521,114 applies pole material consisting of thread sheets groupwise to and perpendicular to band shaped intermediate layers. The threads are then so cut off that they lie flush with one longitudinal edge of the band and extend beyond the other longitudinal edge of the band. Finished pile carpet panels can be obtained by cutting such panels from blocks consisting of several layers of such fixed pole threads. Disadvantages of this process are the lack of mechanical anchoring of the pole threads and the complicated positioning of the pole threads on the band shaped intermediate layers.

In CH-PS 546,564 a pile carpet as well as a process for its manufacture is described which seeks to overcome the above-described drawbacks. The pile consists in this case of floating weft threads of a woven web whose warp threads are so arranged and the weft threads so interwoven therewith that they later form the basis of the pile carpet. The woven web is wound up in an intermediate step and is then slit in the next step into bands which are so bonded together that the warp threads come to lie upon one another and form the base of the carpet while the floating weft threads form the carpet pile. A substantial disadvantage of the process of CH-PS 546,564 lies in the fact that the woven webs are wound-up in an intermediate step before the bonding and cutting operation. Through storing on wound coils and by following steps of unwinding and cutting, the woven bands are so deformed that a uniform reproducible pattern cannot be achieved in the final carpet. This is further aggravated by slitting the woven web into bands which over their entire lengths have free floating weft threads along one edge. Through the loose construction of the textile with a small number of weft threads per centimeter and a low number of warp threads the textile is quickly distorted so that a successful alignment is not possible.

The object of the invention is to provide an installation for the manufacture of textile flat bodies allowing a simple, economical and precise manufacturing, so that it is especially suited to the making of patterned textile bodies.

The required high precision can be attained since this installation working in-line with a weaving or knitting machine, preferably a warp knitting machine, assures not only a firm binding of the pile threads into the edge section but also produces directly flat bodies without intermediately storing the web on wound rolls. Therefore the entire course of the process from weaving or knitting to the production of the flat body can be exactly controlled so that perfect depositing of band segments in the magazine is possible. By avoiding the intermediate storing on rolls and by maintaining, at least partially, the band tension from the weaving or knitting machine up to the stacking apparatus, not only is a great precision achieved but also high cohesion since the woven or knitted edge sections are not disturbed by an intermediate storage.

Preferred embodiments of the installation are described in claims 2 thru 16.

The installation for manufacturing a flat textile body is distinguished by a series of various advantages. Since the stacking apparatus is directly connected to the weaving or knitting machine the intermediate storage which would otherwise disturb the structure is omitted and allows the flat bodies to be made with high precision in a uniform reproducible pattern. By the direct link of the stacking apparatus and the weaving or knitting machine, the bands can be held in a controllable, constant tension up to the stacking machine so that a distortion of the band is avoided or is at least equal for all band segments. A substantially increased accuracy of repetition occurs which also has an advantageous effect on the cohesion and on the pattern of the band segments and resulting flat bodies.

The weaving or knitting machine can be equipped to produce individual bands directly in the width as required for stacking. Advantageous however is an installation whereby a wide web is cut into individual bands, double bands or plural bands. This cutting can take place at different locations in the installation. However, preferably it takes place directly adjacent the weaving or knitting heads.

By means of a pressing device the joining of the individual band segments can be improved and it can also be assured that the individual flat textile bodies attain the same density. Principally it is possible to arrange the magazine horizontally so that the band sections can be brought together in vertical alignment. Advantageous however is an embodiment in which the compartment is vertically arranged in the magazine to make the depositing of the band segments on top of one another very simple.

The band segments can be separated from the band by a severing apparatus before being transported to the magazine. The accuracy of the manufacturing of the flat bodies is improved when the band segments are cut directly adjacent to the magazine, the band segments already being within the compartments of the magazine.

The installation can be provided with an advantageous transfer device having a body with a bearing surface possessing vacuum openings or carrier pins for conveying the band segments into the magazine.

The connection of the band segments to one another can take place either directly in the magazine or later outside the magazine through coating of the rear side of the stack. It is also possible, to make the weft threads and/or the warp threads out of thermoplastic materials which are then plasticised by means of a heating device so that band segments neighboring one another are welded together. It is also possible to apply a thermoplastic adhesive and to connect the band segments lying above one another by plasticised adhesive. It is also possible to apply a liquid adhesive layer to the edge sections of the uppermost band segment with the subsequent band segment being bonded to the preceding band segment.

Especially advantageous is an embodiment of the installation wherein fraying after cutting is avoided through stiffening of the band at the cutting section.

A tensioning device for the control of tension of the bands between the weaving or knitting machine and the magazine has a dancer roll and associated limit switches for controlling the drive speed of at least a portion of the installation.

Distortion free transfer of the band from the weaving machine or the knitting machine can be improved by the embodiment in which a transfer apparatus having transport belts is arranged between the weaving or knitting machine and the stacking machine.

Figure 2:
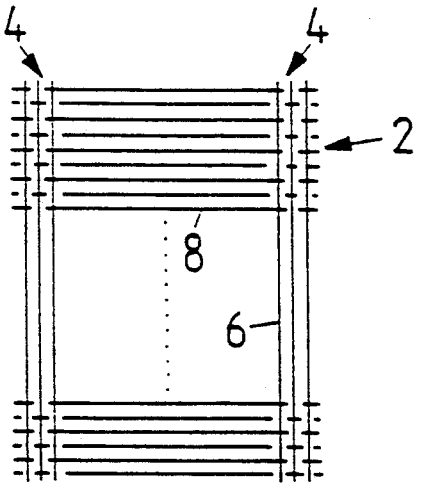
Figure 3:
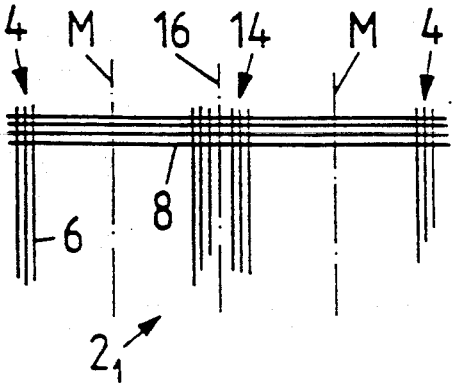
Figure 4:
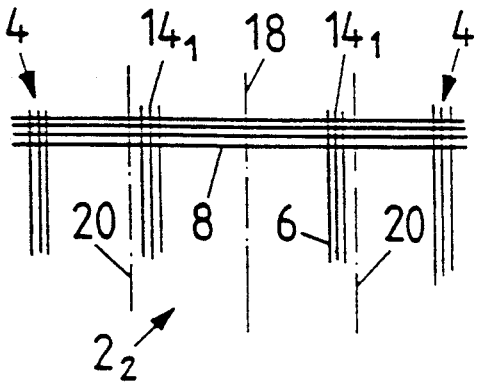
Figure 5:
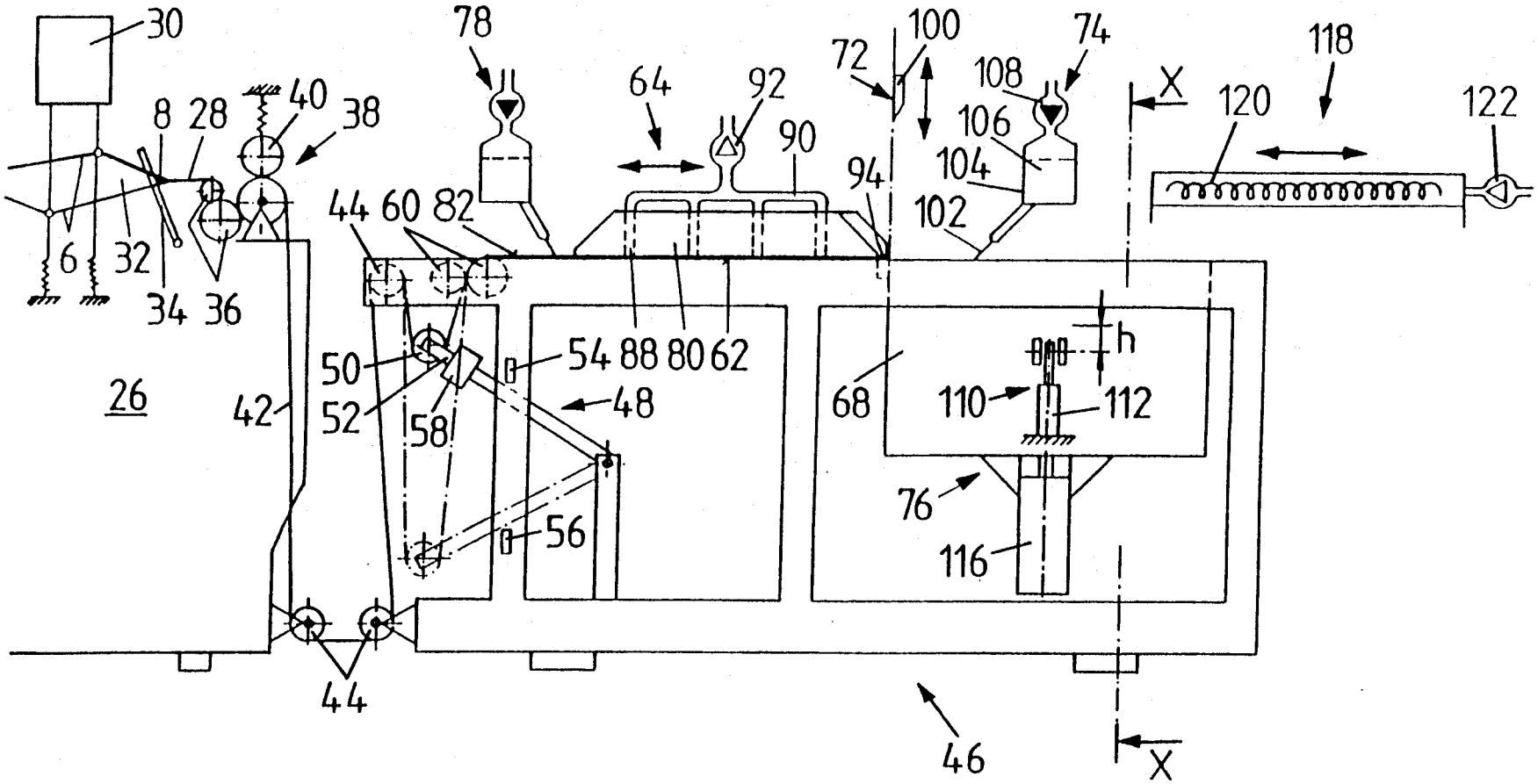
Figure 6:
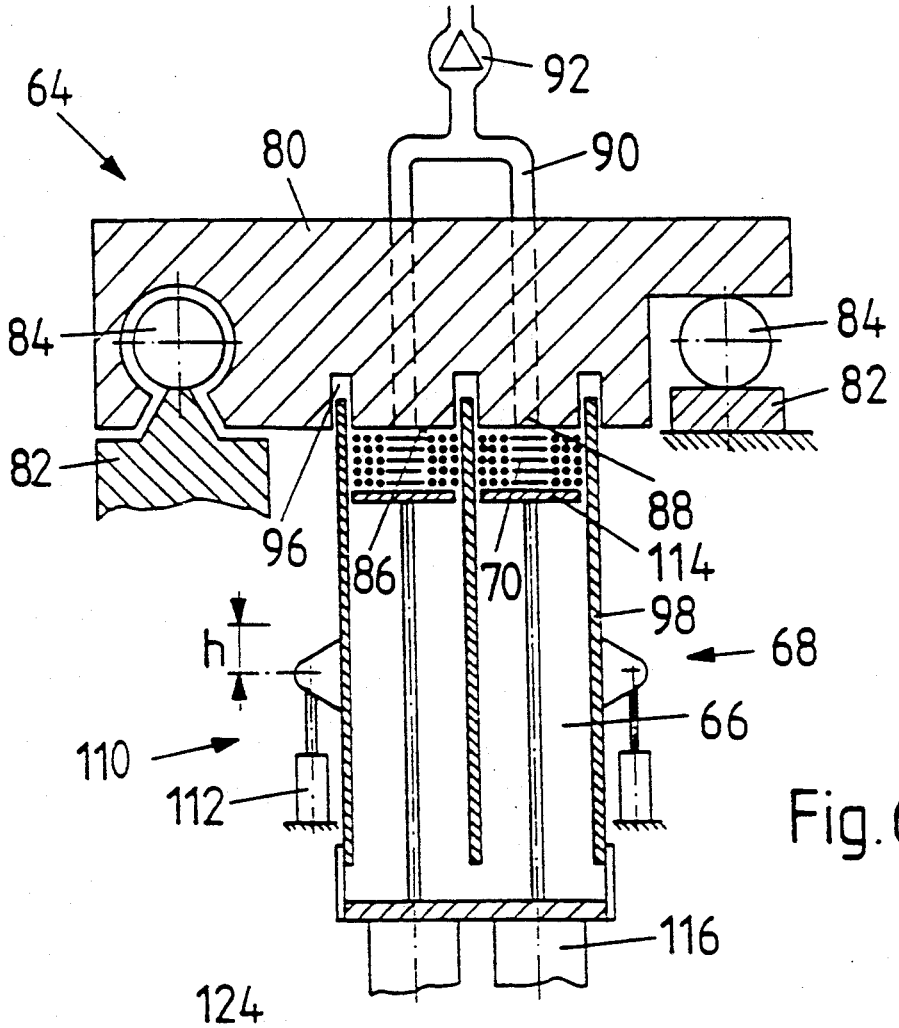
Figure 7:
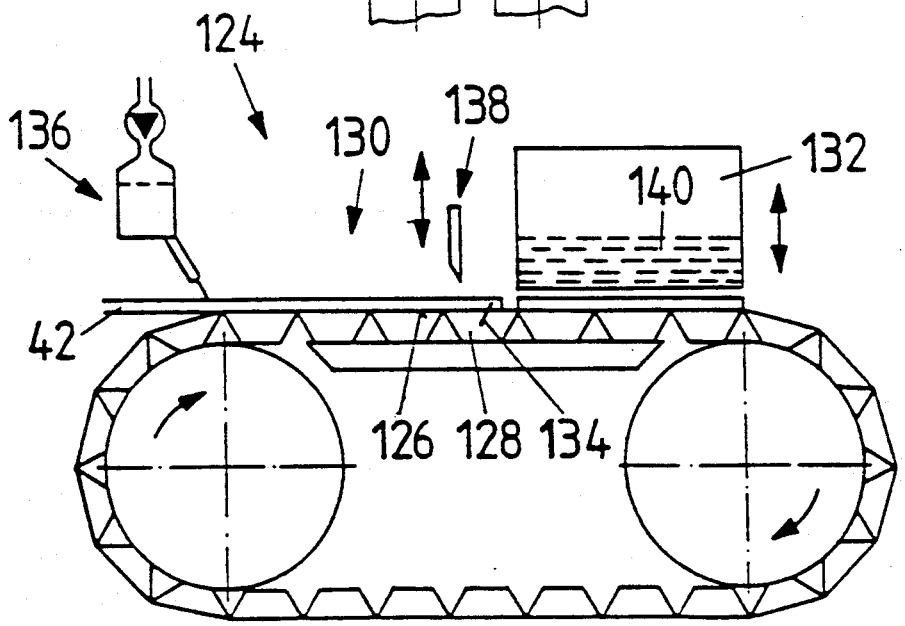
Figure 8:
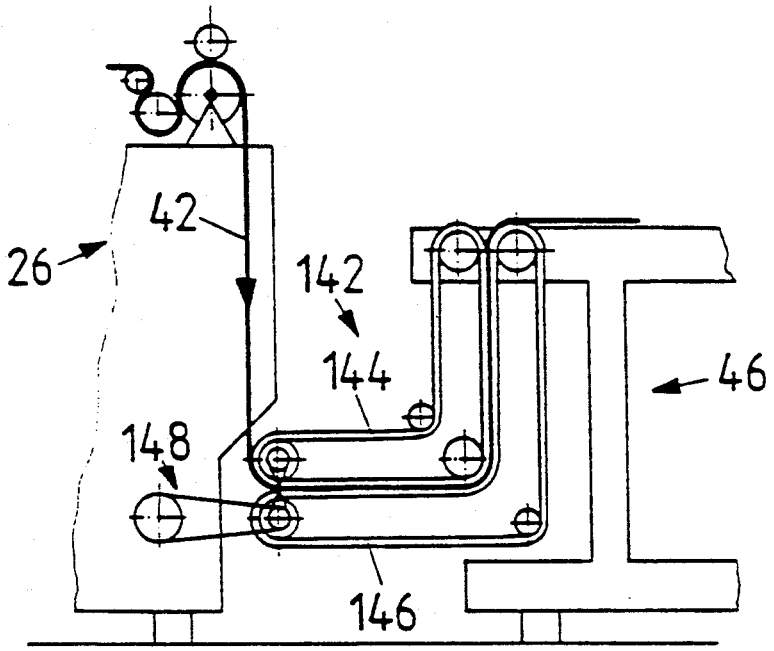

Preferred embodiments of the subject matter of the invention are hereinafter described in more detail in connection with the schematic drawings which show:

FIG. 1 Partial view of a flat body in perspective view;

FIG. 2 a plan view of a section of a band for manufacturing the flat body of FIG. 1;

FIG. 3 a plan view of a section of a band with three woven or knitted sections;

FIG. 4 a plan view of a band with four woven or knitted sections;

FIG. 5 a side view of an installation for manufacturing the flat bodies;

FIG. 6 a section along line X—X of FIG. 5 showing the transfer device and the magazine;

FIG. 7 a side view of a further embodiment of the transfer device and of the magazine;

FIG. 8 a transport apparatus between the weaving machine and the stacking apparatus;

FIG. 1 shows a textile flat body, in a sectional and perspective representation, having a length L, a width B, and a thickness D. The flat body s made of individual band segments 2, which in FIG. 2 are shown in plan view. These band segments consist of marginal sections 4 in which warp threads 6 are woven or knitted with weft threads 8. The weft threads float between the marginal sections 4. These band segments 2 are laid over one another in the form of a stack and are connected at the marginal sections 4. This connection can take place either through a layer of adhesive 10 layered between the marginal sections of neighboring band segments 2, as illustrated in FIG. 1, and/or through a thermal welding of the warp threads and/or the weft threads if these are made of thermoplastic material and/or through the coating or impregnating of the main surfaces H with a binding material. The band segments lie perpendicularly to the main center plane M and to the main faces H of the flat body.

The textile flat body of the type illustrated in FIG. 1 can be used directly, e.g. as an insulating panel limiting the transmission of heat or sound, as a filter sandwich, as reinforcement of synthetic resins and for similar applications. From one such flat body two mirror image symmetrical pile carpet panels can be made by cutting the weft threads 8 parallel to the main central plane M.

FIG. 3 shows a further band section $2_1$, in which the floating weft threads between the marginal sections 4 in their middle portion have a section 14 at which the weft threads 8 are woven or knitted with further warp threads 6. Such a band $2_1$ can in turn be used for the manufacture of a flat body in which higher strength is achieved through the additional middle section 14. Such a flat body can be divided into two flat bodies of the type illustrated in FIG. 1 by severing along the separation plane 16. These in turn can be used directly or in the previously mentioned manner can be divided again into pile carpet panels by severing along the main central planes M.

FIG. 4 shows as a further example, a band segment $2_2$ in which next to the knitted or woven marginal sections 4 two additional sections $14_1$ are provided at which the weft threads 8 are woven or knitted with the warp thread 6. The flat body made from these band segments $2_2$ can also be used either directly or can be cut into pile carpet panels by severing the flat body made from the band segments $2_2$ along its middle plane 18 as well as along two further planes 20 which directly border on the sections $14_1$ and specifically on the sides facing the edge sections 4.

FIGS. 5 and 6 show an installation for manufacturing a flat body. This installation contains a machine 26 which in the present example is a weaving machine and permits manufacture of a woven web 28. The weaving machine 26 is of usual construction. A shedding mechanism 30 lifts and lowers the warp threads 6 for forming a weaving shed 32 through which one weft thread is carried. A weaving reed 34 serves to beat up the weft threads 8. The woven web 28 so formed is taken over several rolls 36 to a cutting device 38 which by means of a cutting knife 40 slits the woven web 28 into individual bands 42 for example of the type illustrated in FIG. 2. From the weaving machine 26 the bands 42 are delivered to a stacking apparatus 46 over various guide rolls 44. Between the weaving machine 26 and the stacking apparatus 46 is a tension device 48 which provides for at least nearly uniform band tension so that the band tension in the stacking apparatus is at least a fraction, for example half, the band tension in the weaving machine.

The tension apparatus 48 includes a dancer roll 50 fastened to a swinging arm 52 which cooperates with limit switches 54, 56 to control the motion of the transfer device 64. If for example the upper limit switch 54 is actuated by the swinging arm 52 either the speed of the stacking apparatus 46 is lowered or the speed of the weaving machine 26 is increased. On the other hand, if the swinging arm 52 moves against the lower limit switch 56, this indicates excessive feeding of the band 42. Accordingly, the actuation of the limit switch 56 works in the opposite sense to effect a reduction in the speed of the weaving machine 26 or an increase in the speed of the stacking apparatus 46. The swinging arm 52 is so adjusted by a weight 58 or a spring that the bands 42 are always held under constant tension. The dancer roll 50 serves as a buffer for the bands 42 continuously produced by the weaving machine 26, and taken up by the stacking machine 46 in step-wise fashion.

The stacking apparatus 46 has delivery rolls 60 working against one another which grip the bands and move them to a support platform 62 from which they are taken by a transfer device 64 and segmentwise transferred into compartments 66 of a magazine 68 and stacked on one another in packets 70. A severing mechanism 72 associated with the magazine 68 serves for severing the band segments from the bands 42. A mechanism 74 is further provided for joining the band segments in the magazine. A press mechanism 76 serves to press the packets 70 made of the band segments 2 into the magazine 68. A device 78 serves to reinforce or stiffen the bands 42 at the transverse cutting section or severing station provided for severing the band segments 2 from the bands 42.

The transfer device 64 has a body 80 movable back and forth on rails 82 and ball bearings 84 between the support table 62 and the magazine 68. The body includes on its bearing surface 86 different vacuum openings 88 connected with a pump 92 by vacuum ducts 90. Additionally, the body 80 includes pins 94 which extend into the bands to serve as carriers. Further, the body is provided with grooves 96 in which the walls 98 of the magazine bordering the compartments are received during compression of the packets 70, as explained in more detail below.

The severing mechanism 72 contains a knife 100 moving up and down operating when the transfer device 64 has brought the band 42 into the magazine. The severing device 72 can be adjusted in a non-illustrated way to adjust the length of the band segments deposited in the magazine.

The magazine 68 is further connected with the device 74 for connecting the band segments 2. The device 74 contains nozzles above the marginal sections 4 of the band segments 2, connected with a pressure container 104 and from which nozzles adhesive 106 is applied to the marginal sections in the form of beads by a pump 108. The device 74 passes over the band segments synchronously with the movement of the body 80 of the transfer device 64 so that immediately before bringing a band or band segment to the magazine, the uppermost band segment is provided with a bead of adhesive.

As already mentioned above, the magazine contains a device 76 to compress band sections into the compartments 66 of the magazine 68. For this purpose the magazine 68 includes lifting devices 110 which raise and lower the compartments 66 for example, pneumatically or hydraulically actuated piston/cylinder devices 112. In the lowered position the body 80 of the transfer device 64 can be driven over the magazine and the preceding band segments. As soon as the body 80 is over the magazine 68 the lifting apparatus 110 lifts the magazine so that the newly laid band segment is pressed onto the preceding band segments 2. The pressure is determined by the lifting device 110 and the counterpressure of the floor 114 in each compartment 66 connected to device 116 which delivers a measured counterpressure and effects a lowering of the floor upon an increase of the number of band segments laid into the magazine. The counterpressure can also be created by friction in that the width of the compartments is slightly smaller than the width of the band segments so that these are pinched as they are moved into the compartments.

The body 80 and/or walls 98 of the compartments 66 can be provided with a non-illustrated heating apparatus to accelerate the hardening or drying of the adhesive. It is, however, also possible to move an additional heating apparatus 118 over the compartments 66 of the magazine 68 when the body 80 of the transfer apparatus 64 is returned to the receiving position over the support table 62. The heating apparatus 118 contains a heating coil 120 and a blower 122 by means of which hot air can be blown onto the packets 70 in the magazine 68. This apparatus can, if need be, contain severing knives to serve as substitutes for the severing apparatus 72 for transverally severing the band segments 2 from the bands 42.

The apparatus 78 for stiffening the bands at the transverse severing station applies an adhesive over only small areas of the band segments 2.

FIG. 7 shows a further embodiment of a stacking machine 120 in which the support platform 126 consists of a circulating belt 128 which simultaneously forms the transfer apparatus 130 for transferring the band segments into the magazine 132. The band 128 contains carrier pins 134 which grip the bands 42 and move them past and below a mechanism 136 for applying an adhesive and below a transverse cutting apparatus 138, which cuts band segments 2 of desired length from the bands 42. Thereafter, the conveyor belt 128 conveys the band segments 2 under the magazine 132. Through lowering of the magazine 132 the band segments on the conveyor belt 128 are captured and simultaneously are joined with the packets 140 in the magazine 132. Upon raising of the magazine 132 the band segments 2 are taken from the conveyor belt 128.

FIG. 8 shows a transport device 142 arranged between the weaving machine 28 and the stacking apparatus 46 which consists of two transport belts 144, 146 lying against one another and between which the band 42 is so guided that stretching of the band 42 is avoided. The transport belts are driven through a suitable drive 148 synchronous with the weaving machine 26.

Further embodiments are imaginable. Especially instead of the apparatus for applying the adhesive 74 band segments can be used which contain thermoplastic threads which upon heating can be welded together.

The described installation is not only suited to processing band segments of the type shown in FIGS. 1 to 4 but also segments that have only one woven or knitted marginal section along one edge and free, unbound pile threads along the second edge. Such a band segment for example is formed by cutting through the band segment of FIG. 1 longitudinally to the main central plane.

In addition to the described installation the connection can also take place by coating a stack of band segments on its rear sides, that is on the main surfaces, with a binding agent, adhesive, coating material or the like.

Flat textile bodies manufactured by the installation can either be used directly as end products or can be cut along their main central planes, in accordance with the previously mentioned method, into pile carpet panels.

We claim:

1. An installation for producing textile flat bodies comprising a) a weaving or knitting machine for manufacturing a band having at least one edge section and floating web threads;

b) a stacking apparatus directly following the weaving or knitting machine having a magazine with one or more compartments for receiving a packet of band segments arranged in stacked relationship;

a severing mechanism for cutting the band segments from the band;

a transfer device for delivering the band or the band segments to the compartment of the magazine; and c) a tension device for maintaining nearly uniform band tension from the weaving or knitting machine to the magazine whereby the band tension in the packeting apparatus has a value equal to at least a fraction of the band tension in the weaving or knitting machine.

2. An installation according to claim 1, wherein the weaving or knitting machine is constructed to manufacture at least one web with several sections connected with floating weft threads, and having a cutting device for dividing the web into individual bands, said cutting device following the weaving or knitting station.

3. An installation according to claim 1 wherein a press mechanism for pressing the packets of band segments is connected to with the magazine.

4. An installation according to claim 1, wherein the compartment is vertically arranged in the magazine so that the band segments are vertically stacked on one another.

5. An installation according to claim 1 wherein walls of the compartment are heatable.

6. An installation to claim 1 wherein the severing mechanism for cutting off the band segments is connected to the magazine and is operable after insertion of the band into the compartment, the severing mechanism having an operating station that is adjustable.

7. An installation according to claim 1 wherein the transfer device includes a body moveable back and forth between a receiving position in advance of the magazine and the compartment of the magazine, said body having a bearing surface with vacuum openings.

8. An installation according to claim 1 wherein the stacking apparatus includes a mechanism for connecting the band segments along the edge sections.

9. An installation according to claim 8 wherein the mechanism for connecting the band segments includes a heating device associated with the magazine for heating the band segments, and welding together thermoplastic threads of the band segments lying on one another.

10. An installation according to claim 8, wherein the mechanism, for connecting the band segments includes an apparatus for dispensing an adhesive coat at least on the edge sections of the uppermost band segment in the compartment of the magazine.

11. An installation according to claim 1 further including an apparatus for stiffening the band segment near the severing station which stiffening apparatus includes a heating member.

12. An installation according to claim 1 wherein the tension device includes a dancer roll with a swinging arm having limit switches for controlling the motion of at least a portion of the installation.

13. An installation according to claim 1, wherein a transport device is arranged at least zonewise between the weaving or knitting machine and the stacking apparatus, which transport device for transport belts lying on one another between which the band is conveyed.

14. An installation according to claim 1 wherein the transfer device includes a body moveable back and forth between a receiving position in advance of the magazine and the compartment of the magazine, said body having a bearing surface with carrier pins.

15. An installation according to claim 1 further including an apparatus for stiffening the band segment near the severing station which stiffening apparatus includes an apparatus for dispensing an adhesive material.

* * * * *